US006397834B1

(12) United States Patent
Kim

(10) Patent No.: US 6,397,834 B1
(45) Date of Patent: Jun. 4, 2002

(54) BROWN GAS HEATING FURNACE MADE OF MINERAL STONE

(76) Inventor: Sang Nam Kim, 104/202, Hyundai, Apt. 23-3, Cheondam-2Dong, Kangnam-Ku, Seoul (KR)

( * ) Notice: Subject to any disclaimer, the term of this patent is extended or adjusted under 35 U.S.C. 154(b) by 0 days.

(21) Appl. No.: 09/552,871

(22) Filed: Apr. 20, 2000

(30) Foreign Application Priority Data

Apr. 22, 1999 (KR) ..... 99-14462

(51) Int. Cl.[7] ..... F24C 15/24; F24D 15/00
(52) U.S. Cl. ..... 126/92 C; 126/8
(58) Field of Search ..... 126/92 C, 8

(56) References Cited

U.S. PATENT DOCUMENTS 1,704,875 A * 3/1929 Vaughn ..... 126/92 C
6,183,604 B1 * 2/2001 Santilli ..... 204/172

FOREIGN PATENT DOCUMENTS

JP 01063725 A * 3/1989
JP 04043224 A * 2/1992
JP 11264507 A * 9/1999
WO WO-9210709 A1 * 6/1992

* cited by examiner

*Primary Examiner*—Sara Clarke
(74) *Attorney, Agent, or Firm*—Patton Boggs LLP

(57) ABSTRACT

The Brown gas heating furnace made of mineral stone maintains a desired temperature with a small amount of fuel. The brown gas heating furnace includes a hollow base, having burner mounting holes formed in a top wall of the base, and a door mounted at a front side of the base. The burners are centrally mounted in the burner mounting holes of the base, with branch ducts connecting each of the burners to a Brown gas supply duct. A heating section consisting of firebricks stacked together in a staggered fashion on the top wall of the base encloses the burner mounting holes, with a furnace section seated on the base and having a combustion chamber surrounding the heating section. The furnace section also has venting holes adapted to vent the combustion chamber to the atmosphere. The furnace section may include stacked blocks made of mineral stone, biotite, germanium, or jade, or may use hollow mineral stones.

5 Claims, 4 Drawing Sheets

BROWN GAS HEATING FURNACE MADE OF MINERAL STONE

CROSS REFERENCED/RELATED APPLICATIONS

This application claims a priority date of Apr. 22, 1999 based upon Application Number 1999-14462 in the Republic of Korea.

FIELD OF THE INVENTION

The present invention relates to a Brown gas heating furnace made of mineral stone, and more particularly to a heating furnace comprising a base for supporting a burner assembly for burning a brown gas, and a heating section consisted of stacked firebricks.

DESCRIPTION OF THE RELATED ART

Generally, to implement a high capacity space heater, a carrier with a number of mineral stones being stacked thereon is heated in a fossil fuel powered industrial furnace to reach a temperature of between 700 to 800° C. Once the mineral stones have reached this temperature, they are moved to the room that is to be heated. According to the method for heating the mineral stones stacked on the carrier, a great quantity of air must be supplied to a combustion chamber by means of a blower in order to burn the fossil fuels. This combustion process generates exhaust gas vented through a chimney in a volume that is as much as the quantity of combustion air that is fed into the combustion chamber. The loss of energy associated with the gas that is exhausted through the chimney is about 60%. Also, since liquefied petroleum gas is used to heat the stacked mineral stones, a great quantity of fuel is needed. Since the industrial furnace is large, a great amount of space is needed to install the furnace Furthermore, the liquefied petroleum gas is an explosive substance, and it is therefore unsuitable for use in a service office having a large number of occupants. The maximum amount of far infrared rays (having a wave length of 5.6 to 15 micro meter and being beneficial to the human body) radiates from the mineral stones at a temperature range of 300 to 400° C. It is therefore not necessary to heat the mineral stones above that temperature. If the mineral stones are heated up to 700 to 800° C., infrared rays and ultraviolet rays, as well as the above-noted beneficial far infrared rays, radiate from the mineral stones and this additional radiation is harmful to human body.

In addition, if the mineral stones stacked on the carrier drop below a desired temperature, the carrier must be moved to the industrial furnace to reheat the mineral stones.

Since the mineral stones have a lower melting point relative to other materials, the physical properties of the mineral stones may be changed due to the repeated heating, so that amount of the far infrared rays that are radiated may be reduced and the useful life of the mineral stones may be shortened.

SUMMARY OF THE INVENTION

Accordingly, the present Brown gas heating furnace made of mineral stone is directed to an apparatus for heating mineral stones by adopting a Brown gas as a fuel. This Brown gas heating furnace made of mineral stone substantially obviates the problems due to the limitations and disadvantages of the related art.

The brown gas has some special characteristics, such as no pollution, and complete combustion. The brown gas is a mixed gas of hydrogen and oxygen in a ratio of 2:1, so that smoke, soot, or the like are not generated during the combustion of the brown gas. Therefore, there is no needed of a chimney. Since the Brown gas can be burned in the closed space, a great amount of heat is accumulated inside the heating furnace and not lost through the venting of exhaust gases. An object of the present invention is to provide a Brown gas heating furnace made of mineral stone that can maintain a constant temperature with a small amount of fuel.

In order to achieve the above object, the present invention provides a brown gas heating furnace made of mineral stone. In accordance with this invention, the heating furnace comprising a hollow base, having at least one burner mounting hole formed at a top wall of the base, and a door mounted at a front side of the base uses at least one burner centrally mounted in the at least one burner mounting hole of the base to generate a flame to combust the Brown gas. The burners are connected via branch ducts to a supply duct that supplies brown gas to the at least one burner, and at least one valve respectively mounted on the at least one branch duct to regulate the flow of Brown gas. The Brown gas heating furnace made of mineral stone includes a heating section of firebricks stacked together in a staggered fashion on the top wall of the base while enclosing the at least one burner mounting hole. The furnace also includes a furnace section seated on the base and defining a combustion chamber surrounding the heating section while being uniformly spaced apart from the heating section the furnace section also has venting ports adapted to enable air flow between the combustion chamber and the atmosphere.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DESCRIPTION OF THE PREFERRED EMBODIMENTS

Reference will now be made in detail to the preferred embodiments of the present invention, examples of which are illustrated in the accompanying drawings.

Figure 1A:
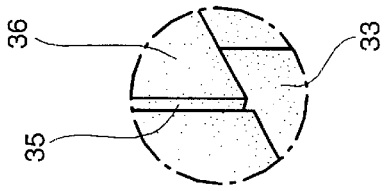
FIG. 1 is a perspective view illustrating the entire structure of the present Brown gas heating furnace made of mineral stone.
Figure 1:
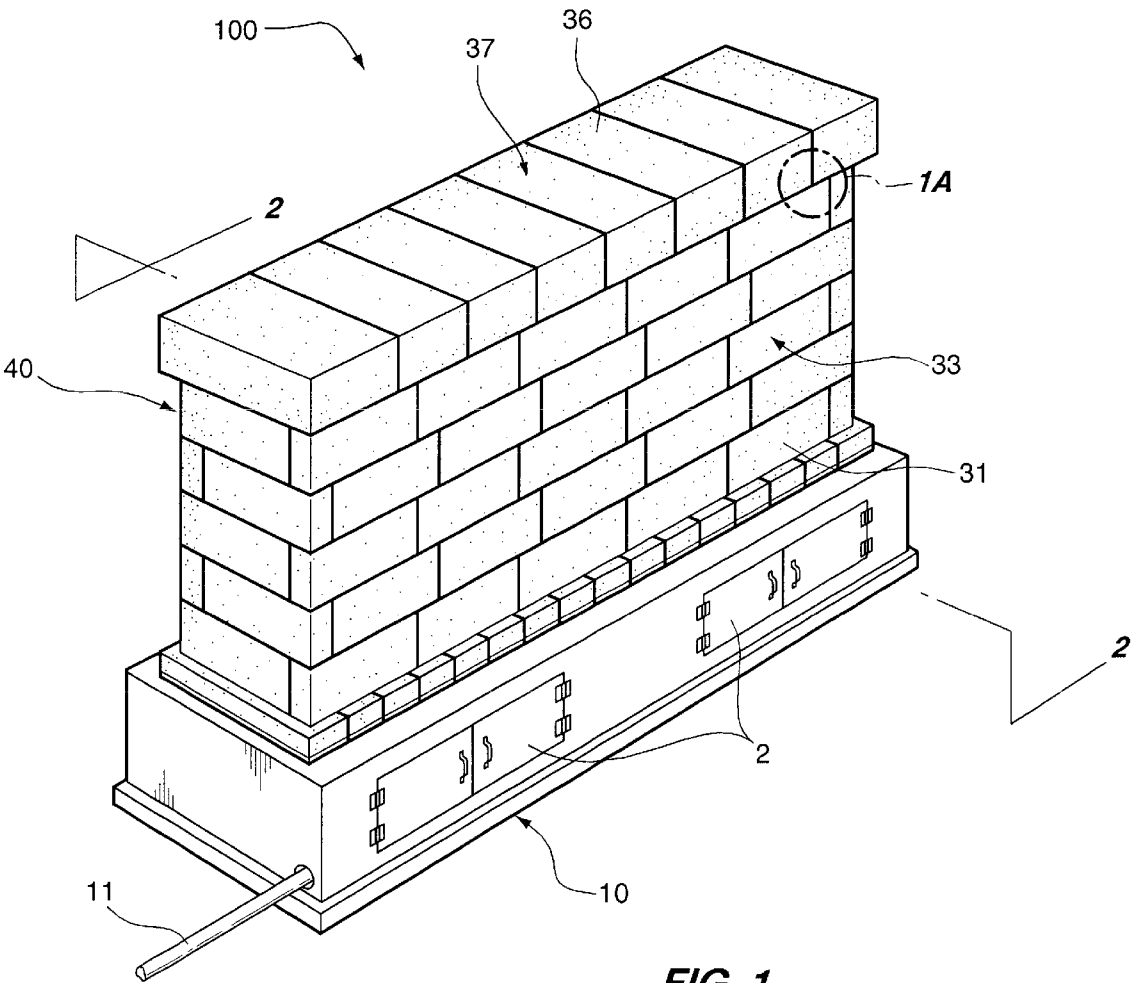

FIG. 1 is a perspective view illustrating the entire construction of the a Brown gas heating furnace made of mineral stone 100 according to one embodiment of the present invention in which the apparatus a Brown gas heating furnace made of mineral stone 100 comprises a base 10 for supporting burner assembly 20 for burning brown gas, along with a heating furnace 40, and a heating section 30 supplied directly with a heat by the burner assembly 20. The heating furnace 40 is indirectly heated by the heating section 30, thereby outwardly radiating far infrared rays.

The base 10 is made of steel having a desired thickness and strength and has a rectangular shape with a hollow 5 therein. The base 10 is centrally provided at the top wall thereof with two holes 1 for mounting the burners 14. The holes 1 are spaced apart from each other in a desired distance, with the precise distance being left to a maker of the furnace. Two doors 2 are provided at the front side of the base 10 in order to allow a user to have access to control valves 13 provided on the burner assemblies 20.

Figure 2:
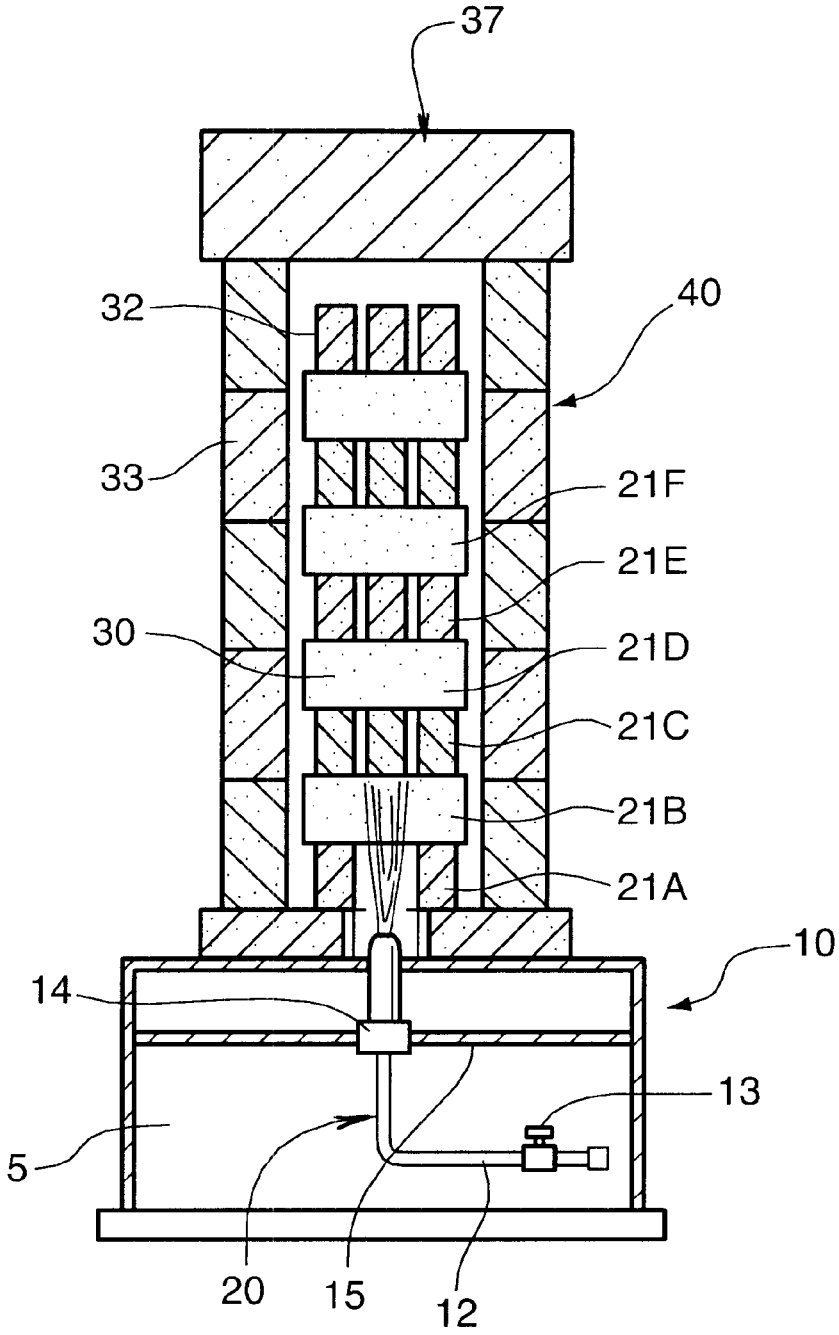
FIG. 2 is a cross sectional view of a line A–A' of FIG. 1.
Figure 3:
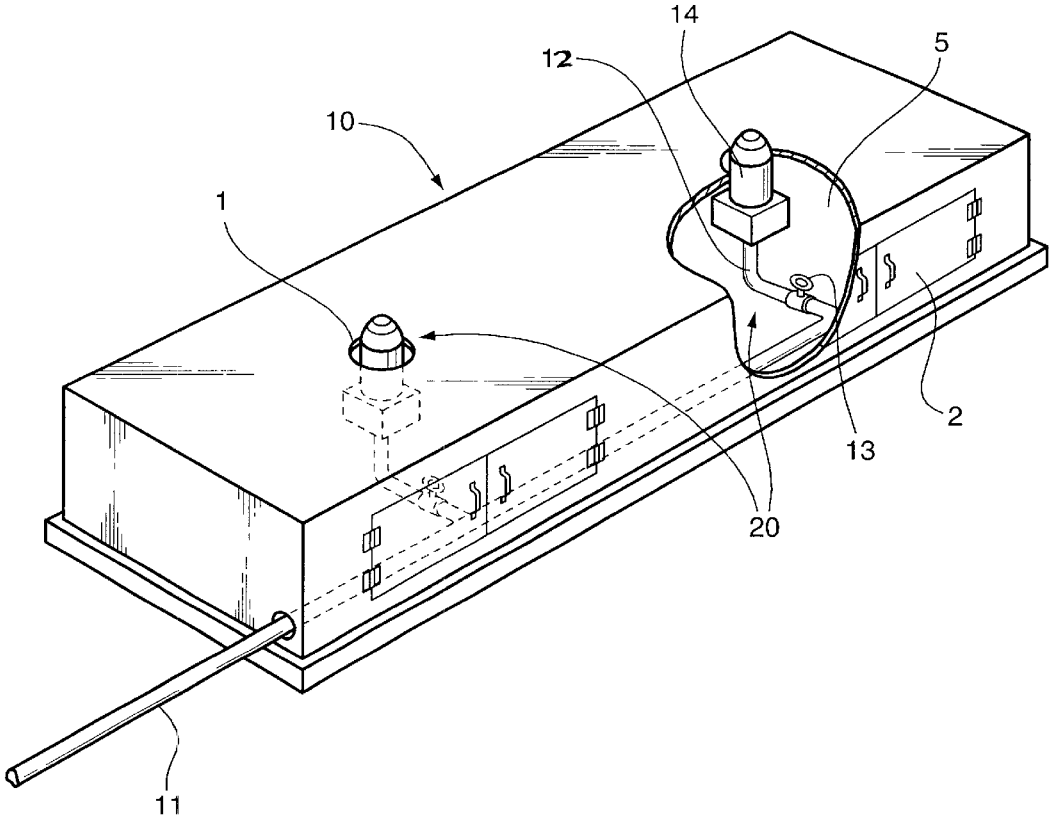
FIG. 3 is a partially cutaway view illustrating the base.

Referring to FIGS. 2 and 3, each burner assembly 20 provided in the base 10 is connected to a supply duct 11 for supplying brown gas generated from a brown gas generator. In the hollow 5 of the base 10, the supply duct 11 is firmly fixed to the base 10 by a supporting bar 15 with one end of the duct being toward the burner 14. Also, the supply duct 11 has a branch duct 12 with a valve 13 for controlling the flow rate of the brown gas.

As shown in FIG. 2, the heating section 30 positioned above of the burner 14 is provided with a combustion chamber for the operation of the heating furnace 40. Specifically, the heating section 30 comprises a multilayer structure 21*a*–21*f* of firebricks, in which firebricks arranged in a first layer 21*a*, a third layer 21*c*, and a fifth layer 21*e* are vertically stacked, respectively, and firebricks arranged in a second layer 21*b*, a fourth layer 21*d*, and a sixth layer 21*f* are horizontally stacked. The heating section 30 is directly heated by the heat of the burner 14 and heats indirectly the heating furnace 40 by a radiant heat generated from the heating section 30.

The heating furnace 40 comprises an outer wall 33 and a cover 37 which are made of a material capable of radiating far infrared rays, such as mineral stone, biotite, germanium, jade, or the like. Each block 31 used in forming the outer wall 33 is machined in a shape of rectangle and is stacked in a plurality of layers. Preferably, the blocks 31 are staggered with respect to each other to obtain a stable structure. Also, the cover 37 consists of a plurality of rectangular blocks 36. The blocks 36 are arranged in such a fashion that adjacent ones thereof are spaced apart from each other to define a gap of about 4 mm. Thus, a number of venting holes 35 are formed, so that any vapor produced by the combustion of the Brown gas is discharged outwardly from the heating furnace 40.

When Brown gas control valve 13 is opened and the burner 14 is ignited, the brown gas feeds from the brown gas generator (not shown) to the burner 14 through the supply duct 11 and branch ducts 12. The burning brown gas heats the firebricks 21 of the heating section 30. At that time, the flame of the brown gas extends from the burner 14 between the first and second layers 21*a* and 21*b*, and directly heats the third layer 21*c* which overlays the first and second layers 21*a*, 21*b* and extends over burners 14 to become red hot. The heat is gradually conducted from first and second layers, 21*a* and 21*b*, to the fourth, fifth, and sixth layers 21*d*, 21*e* and 21*f*. If the entire plurality of layers 21*a*–21*f* contained in the heating section 30 is heated, the temperature within the heating furnace 40 can reach a temperature above about 1,000° C. The high temperatures generated in the heating section 30 heats the outer wall 33 and the cover 37, and then the far infrared rays are radiated from the outer wall 33 and the cover 37. Meanwhile, some vapor generated from the combustion of the brown gas flows upwardly, together with air introduced through the holes 1, and is discharged outwardly from the venting holes 35 formed in the cover 37. In fact, it will be noted visually that a pillar of fire is generated in the upper portion of the heating furnace 40, which is separated from the flame produced by the burners 14. This flame is produced by the heat generated in the closed combustion chamber due to the combustion of the Brown gas.

It will be understood from the below table that the process, of which the heat is generated from the combustion of the Brown gas in the closed combustion chamber, is accomplished by this reaction:

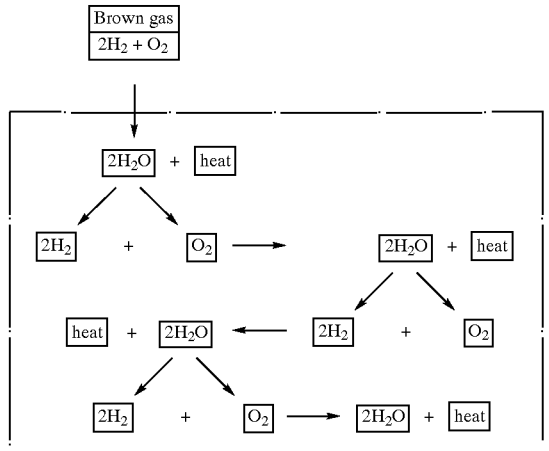

The present Brown gas heating furnace made of mineral stone 100 adopts the property of the Brown gas, so that the air venting port and the chimney necessary to the prior art are eliminated.

As the temperature in the heating furnace 40 ascends, the heating section 30 heated directly by the Brown gas becomes a mass of flames at a temperature of above 1000° C. In addition, if the far infrared rays are radiated to any substance, the electromagnetic wave of the far infrared rays causes a resonance phenomenon in the substance, thereby generating heat energy in the substance due to vibration of the molecules in the substance.

The object of the present invention is to promote health by using the thermotherapy in which the far infrared rays produced by outer wall 33 of the heating furnace 40 radiates to the human body, while the far infrared rays radiated from the outer wall 33 to the inside of the heating furnace 40 provides the desired heating effect. Specifically, the far infrared rays radiated inwardly from the outer wall 33 increases the temperature of the heating section 30 within the heating furnace 40, together with the heat of the Brown gas, so that the interior of the heating furnace 40 is heated with the expenditure of a little energy.

In fact, where the heating furnace of mineral stone 100 is heated by the Brown gas, the temperature of the interior of the heating furnace 40 gradually increases. When the temperature reaches a temperature of 1,000° C., the flow rate of the Brown gas may be reduced by an amount of 50%, a constant temperature of the interior of the heating furnace 40 can be maintained. After that, only a small quantity of fuel is needed to maintain the temperature of the heating furnace 40 at 300 to 400° C.

In particular, the outer wall 33 of the heating furnace 40 is made of a substrate, such as mineral stone, biotite, germanium, jade, or the like. Since the substrate can radiate a maximum amount of far infrared rays at a temperature of 300 to 400° C., the flow rate of Brown gas being fed to the burner 14 can be controlled by the valve 13 to radiate infrared rays of a wavelength band (5.6 to 15 $\mu$m.) beneficial to human body.

According to another feature of the present invention, the heating furnace 40 is heated indirectly by the heating section 30, so that pollution is not exhausted to the atmosphere. The heating furnace 40 may be manufactured in a small size, so that it can be used as a mineral stone stove in a living room in a general house or other like enclosed space.

Figure 4:
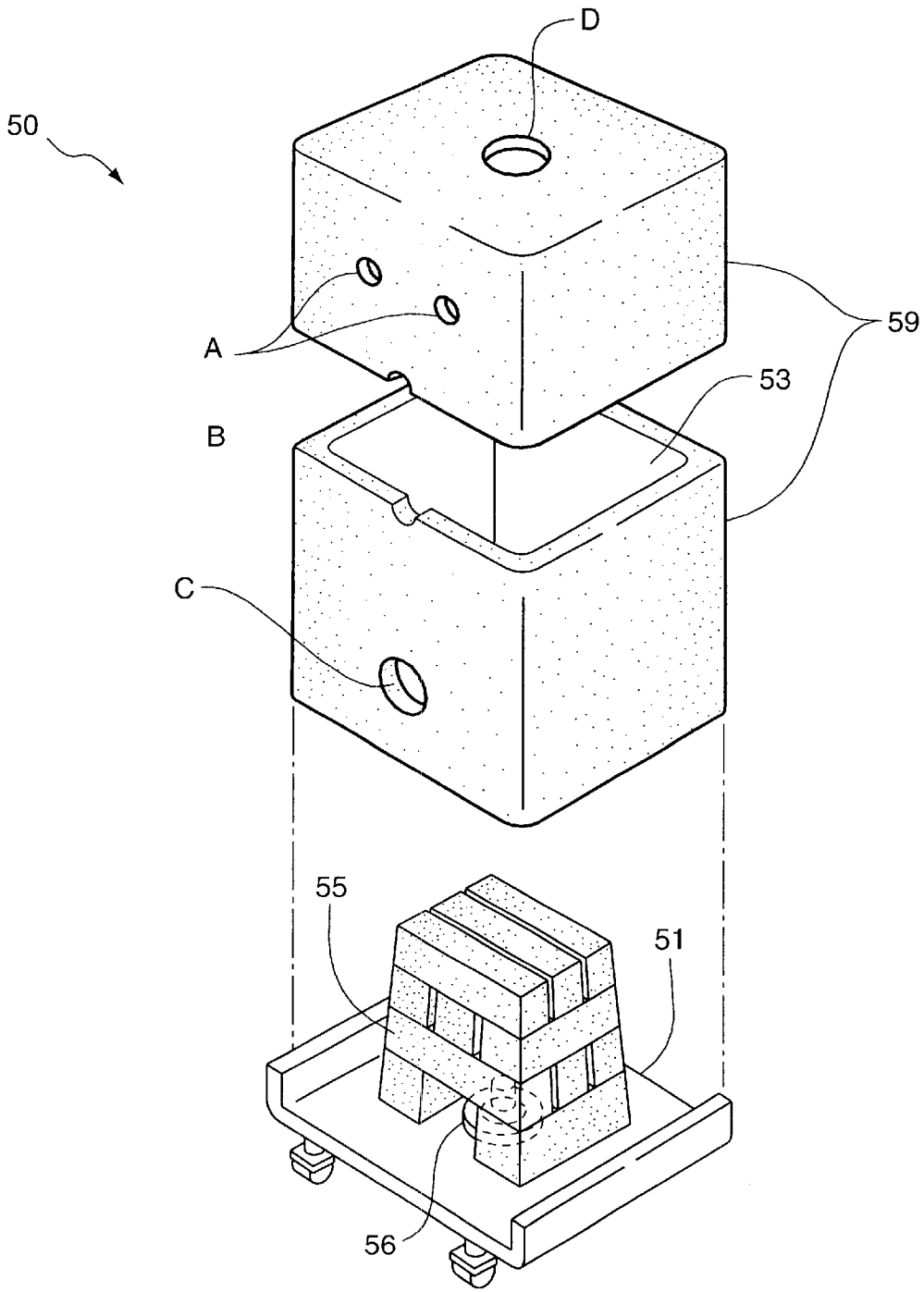
FIG. 4 is an exploded view illustrating the structure of a stove used indoors, according to another embodiment of the present Brown gas heating furnace made of mineral stone used indoors.

Referring to FIG. 4, the mineral stone stove 50 includes a heating furnace 59. Heating furnace 59 consisted of two mineral stones with a hollow 53 formed by stacking the stones vertically, and the heating furnace 59 is mounted on a base 51. The closed hollow 53 functions as a combustion chamber, and encloses a small heating section 55. The flame of Brown gas generated from a burner 56 directly heats the heating section 55. At that time, the heating furnace 59 is heated indirectly by the heat radiated from the heating section 55, and radiates the far infrared rays outwardly. In addition, the heating furnace 59 comprises through holes a, b, c and d to view the inside of the heating furnace and function as a venting port for venting outwardly the vapor produced from the combustion of the Brown gas.

According to the above description of the Brown stone heating furnace 100, the outer wall 33 and cover 37 were made of a mineral stone. The size of the blocks 31 used to form the outer wall 33 was 300 cm×80 cm×140 cm, the size of the block 36 consisting of the cover 36 was 200 cm×140 cm×140 cm. The bottom of the heating furnace 40 was made of steel to support the weight of the heating furnace 40, and was provided on its bottom with two burners 14 oriented vertically. Also, on the base 10, the blocks 31 used to form the outer wall 33 and having a size of 300 cm×80 cm×140 cm were stacked in 5 layers. In the combustion chamber 32 in the center of the heating furnace, the firebricks 21 were stacked in 6 layers perpendicular to the vertical line of the holes 1 for mounting the burners 14, with the firebricks being staggered. At that time, since there were two burners 14, the heating section 30 was also provided in two groups. The cover 37 having a size of 200 cm×140 cm×140 cm was positioned on the upper edge of the outer wall 33. A gap was provided between the blocks 36 in an order of 4 mm to form a hole 35 for venting the vapor generated from the combustion of the Brown gas.

In order to supply the gas to the Brown gas heating furnace 100, at least one Brown gas generator is used to produce gas at a typical rate, such as 1,800 l/s. After the burner 14 is ignited, the temperature of the heating section 30 reached a temperature of 1,100° C. gradually during the course of 4 hours. During this heating cycle, the temperature of outer wall 33 reached to 300° C. Once this temperature is achieved, a decrease in the amount of Brown gas used was achieved by controlling the flow rate of the Brown gas so the driving rate of the generator becomes 50% of the initial flow rate.

After 12 hours of operation in a laboratory environment that was provided with the heating furnace, the temperature of the objects positioned in a room with the furnace increase to over 40° C. by the radiation of far infrared rays, and the air temperature close to the heating furnace was very high. While the present invention has been described and illustrated herein with reference to preferred embodiments, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A brown gas heating furnace made of mineral stone, the heating furnace comprising:

a hollow base having at least one burner mounting hole formed at a top wall of the base, and a door mounted at a front side of the base;

burner means including at least one burner centrally mounted in the at least one burner mounting hole of the base, respectively, at least one branch duct respectively connected to a supply duct adapted to supply brown gas to the at least one burner, and at least one valve respectively mounted on the at least one branch duct;

a heating section including firebricks stacked together in a staggered fashion on the top wall of the base while enclosing at least the at least one burner mounting hole; and a furnace section seated on the base and defined with a combustion chamber surrounding the heating section while being uniformly spaced apart from the heating section also having venting ports adapted to communicate the combustion chamber with the atmosphere.

2. The brown gas heating furnace made of mineral stone as claimed in claim 1, wherein the firebricks of the heating section have a multi-layer structure including a plurality of vertically stacked layers, comprising:

a lowermost and a second lowermost ones of the plurality of vertically stacked layers defining a small space for allowing a formation of flames of brown gas discharged from the at least one burner while allowing the formed flames to come into direct contact with a third lowermost one of the plurality of vertically stacked layers, so that heat from the flames transmitted to the third lowermost one of the plurality of vertically stacked layers is gradually transmitted from the third lowermost one of the plurality of vertically stacked layers to the other ones of said plurality of vertically stacked layers in upward and outward directions, whereby the heating section radiates heat of a high temperature in the combustion chamber.

3. The brown gas heating furnace made of mineral stone as claimed in claim 1, wherein the furnace section comprises:

a plurality of blocks stacked together while defining a space therein, the space serving as the combustion chamber; and a cover adapted to cover an upper end of the furnace section and formed by blocks fixedly laid on the upper end of the furnace section while being spaced apart from one another to define gaps, said gaps forming venting holes for said furnace section.

4. The brown gas heating furnace made of mineral stone as claimed in claim 3, wherein:

the blocks and the cover of the furnace section are made of a material, capable of radiating far infrared rays, selected from the group of materials consisting of mineral stone, biotite, germanium, and jade;

the furnace section is heated indirectly by high-temperature heat radiated from the heating section; and the amount of the brown gas supplied to the at least one burner is controlled by the at least one valve in such a fashion that the temperature of the blocks and the cover of the furnace section is maintained in a range of 300 to 400° C.

5. The brown gas heating furnace made of mineral stone as claimed in claim 1, wherein the furnace section comprises:

at least two hollow mineral stones vertically stacked together while defining a space serving as a combustion chamber, an uppermost one of the vertically stacked mineral stones having a closed top wall; and a plurality of through holes formed through side walls of the mineral stones, the through holes serving as venting holes;

whereby the brown gas heating furnace is usable as an infrared stove.

* * * * *